US006231403B1

(12) United States Patent
Casey et al.

(10) Patent No.: US 6,231,403 B1
(45) Date of Patent: May 15, 2001

(54) APPARATUS FOR ASSEMBLING AN ELECTRICAL CONNECTOR AND METHOD OF USE

(75) Inventors: Daniel T. Casey; George I. Peters, Jr., both of Harrisburg; Jose L. Ortega, Camp Hill, all of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/211,291

(22) Filed: Dec. 14, 1998

Related U.S. Application Data

(63) Continuation-in-part of application No. 08/813,555, filed on Mar. 7, 1997, now Pat. No. 5,865,646.
(60) Provisional application No. 60/077,497, filed on Mar. 11, 1998.

(51) Int. Cl.[7] ..... H01R 4/28
(52) U.S. Cl. ..... 439/760; 29/760
(58) Field of Search ..... 439/760, 464, 439/759, 749, 152; 29/760, 759, 747, 464

(56) References Cited

U.S. PATENT DOCUMENTS

| | | | | |
|---|---|---|---|---|
| 3,601,890 | | 8/1971 | Pityo et al. . | |
| 3,729,809 | * | 5/1973 | Vawter | 29/243 |
| 4,091,530 | * | 5/1978 | Nijman et al. | 29/749 |
| 4,383,361 | | 5/1983 | Kautz . | |
| 4,488,581 | | 12/1984 | Stumph et al. . | |
| 4,520,555 | * | 6/1985 | Gyi et al. | 29/760 |
| 4,837,926 | | 6/1989 | Boutcher . | |
| 4,906,201 | | 3/1990 | Young et al. . | |
| 4,967,470 | | 11/1990 | Folk . | |
| 4,970,781 | * | 11/1990 | Chang et al. | 29/843 |
| 5,017,156 | | 5/1991 | Sugiyama . | |
| 5,085,590 | | 2/1992 | Galloway . | |
| 5,161,997 | | 11/1992 | Defigaugh et al. . | |
| 5,475,916 | * | 12/1995 | Schollenberger | 29/760 |
| 5,588,206 | | 12/1996 | Maejima et al. . | |
| 5,600,881 | | 2/1997 | Wanha . | |
| 5,623,754 | * | 4/1997 | Swann et al. | 29/281 |
| 5,645,479 | * | 7/1997 | Bowen et al. | 29/749 |
| 5,669,135 | | 9/1997 | Verhille . | |
| 5,685,739 | | 11/1997 | Davis et al. . | |
| 5,699,608 | * | 12/1997 | Nakamura | 29/747 |
| 5,702,271 | | 12/1997 | Steinman . | |
| 5,896,649 | * | 4/1999 | Millhimes | 29/760 |
| 6,078,504 | * | 6/2000 | Miles | 361/727 |

FOREIGN PATENT DOCUMENTS

| | | |
|---|---|---|
| 0 743 704 A2 | 5/1995 | (EP) . |
| 0776 070 A2 | 11/1995 | (EP) . |

* cited by examiner

*Primary Examiner*—Khiem Nguyen
*Assistant Examiner*—J. F. Duverne
(74) *Attorney, Agent, or Firm*—Brian J. Hamilla; M. Richard Page

(57) ABSTRACT

An apparatus for mounting an electrical connector on a PCI bracket comprising a base containing a plurality of apertures and at least one spring loaded eject pin, a contact support plate having a plurality of slots used to position contact tails on the connectors, a vertical clamp used to hold the connectors in place and a spring loaded plunger positioned in the base such that the PCI bracket is accurately positioned with respect to the connectors.

5 Claims, 19 Drawing Sheets

APPARATUS FOR ASSEMBLING AN ELECTRICAL CONNECTOR AND METHOD OF USE

CROSS REFERENCE TO RELATED APPLICATIONS

This application is a continuation-in-part of Ser. No. 08/813,555, filed Mar. 7, 1997, now U.S. Pat. No. 5,865,646 and a provision of application Ser. No. 60/077,497 filed Mar. 11, 1998.

BACKGROUND OF THE INVENTION

1. Field of the Invention

This invention relates to electrical connectors and particularly to shielded, high speed connectors.

2. Brief Description of Prior Developments

As signal speeds, in particularly data transfer speeds, have increased, interconnection systems, such as those used for input output terminals for data processing equipment have had to be designed to pass these higher speed signals within acceptable limits of signal degradation. These efforts have involved shielding and impedance control. Such efforts are typified with connectors, such a modular jacks, that have separate metal shields applied over the connector housing. In many instances, these shields are in two parts, one to cover the body of the connector and the other to be applied over the front face of the connector. Similar approaches have been taken for other connectors, such as the HSSDC connector marketed by AMP, Inc., which is designed to meet the ANSI X3T11 Fiber Channel committee standards. However, as signal speeds have increased, the difficulty of meeting impedance control and shielding requirements by the use of such wraparound shields has increased. An additional complication is that these interconnection systems require reliable contact with shielding structures on the mating plug connectors so that overall performance of the interconnection system is maintained.

Another approach that has been taken is illustrated in recent designs of Universal Serial Bus connectors. Recent designs utilize a central insulative molded member to retain the contacts. The outer shell of this connector comprises a formed sheet metal shield that is wrapped about the molded member and forms the walls of the connector housing. One such connector has been marketed by Berg Electronics under the part number designation 87520.

While the above described connectors have been able to achieve adequate performance in terms of minimizing signal degradation at high frequencies, the drive for ever higher signal frequency has necessitated the development of connectors with higher performance capabilities.

SUMMARY OF THE INVENTION

High speed interconnection performance is assured according to the present invention by incorporating latching features directly into a metal shield of the board mounted receptacle connector. In a preferred embodiment, metal latch engagement surfaces are formed directly from bent portions of the metal shield.

Shielding performance is enhanced by providing opposed laterally extending flanges on the shields. The flanges have interfitting structures arranged along an outer edge or distal so that the flanges of adjacent connectors can be interfit, thereby enhancing shielding integrity and minimizing space requirements.

Contacts for establishing electrical connection between the shield of the receptacle conductor and the mating plug connector have a flexural axis extending generally in alignment with the insertion axis of the mating connector. These contacts are canted inwardly from the shield and can be additionally compliant toward and away from the flexural axis. In a preferred embodiment, these contacts are formed integrally with the sheet metal shield.

Also encompassed within the invention is an apparatus for mounting an electrical connector on a PCI bracket comprising a base containing a plurality of apertures and at least one spring loaded eject pin, a contact support plate having a plurality of slots used to position contact tails on the connectors, a vertical clamp used to hold the connectors in place and a spring loaded plunger positioned in the base such that the PCI bracket is accurately positioned with respect to the connectors.

DETAILED DESCRIPTION OF THE PREFERRED EMBODIMENTS

Figure 1:
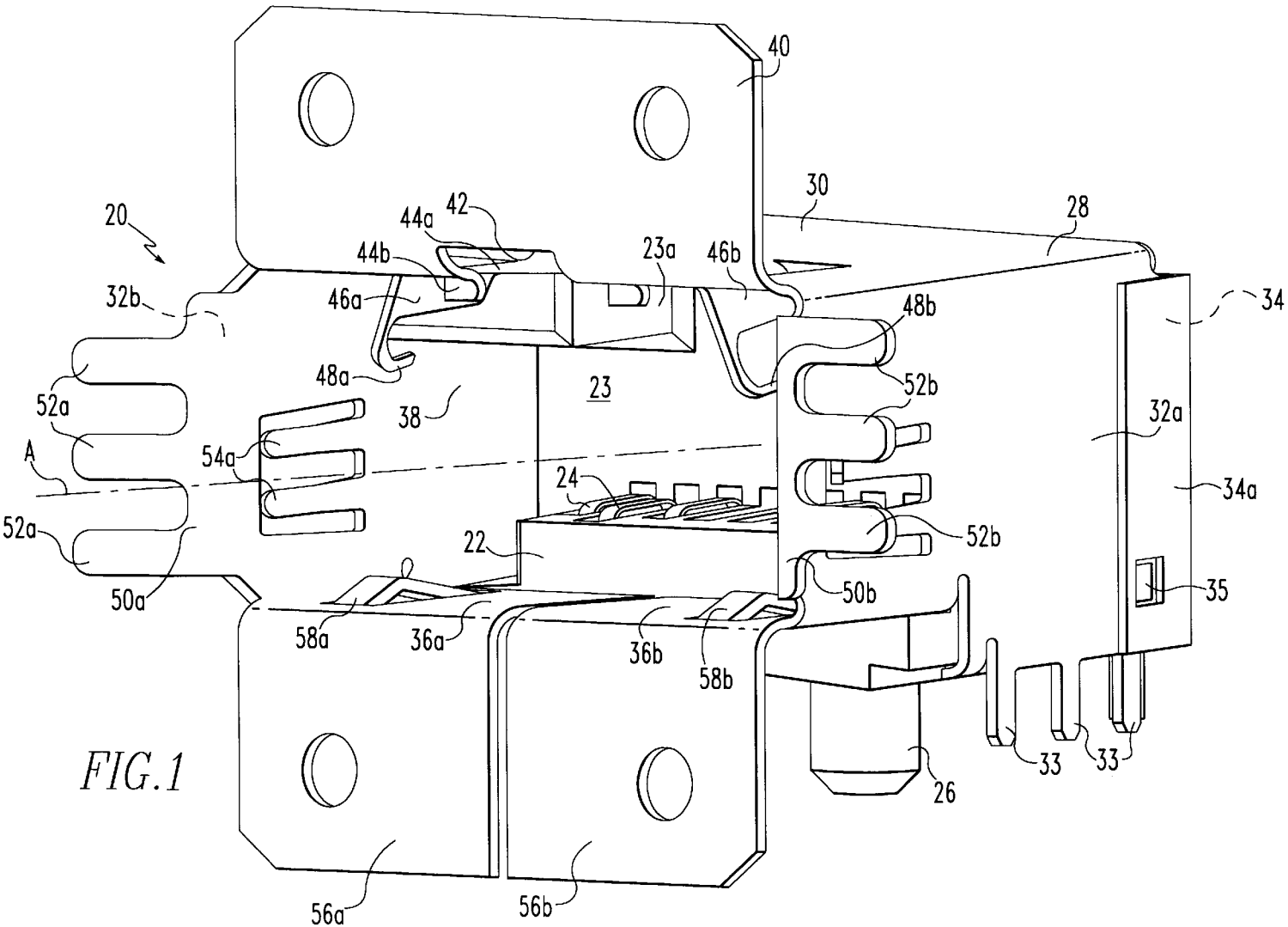
FIG. 1 is an isometric view of the connector embodying features of the invention.
Figure 2:
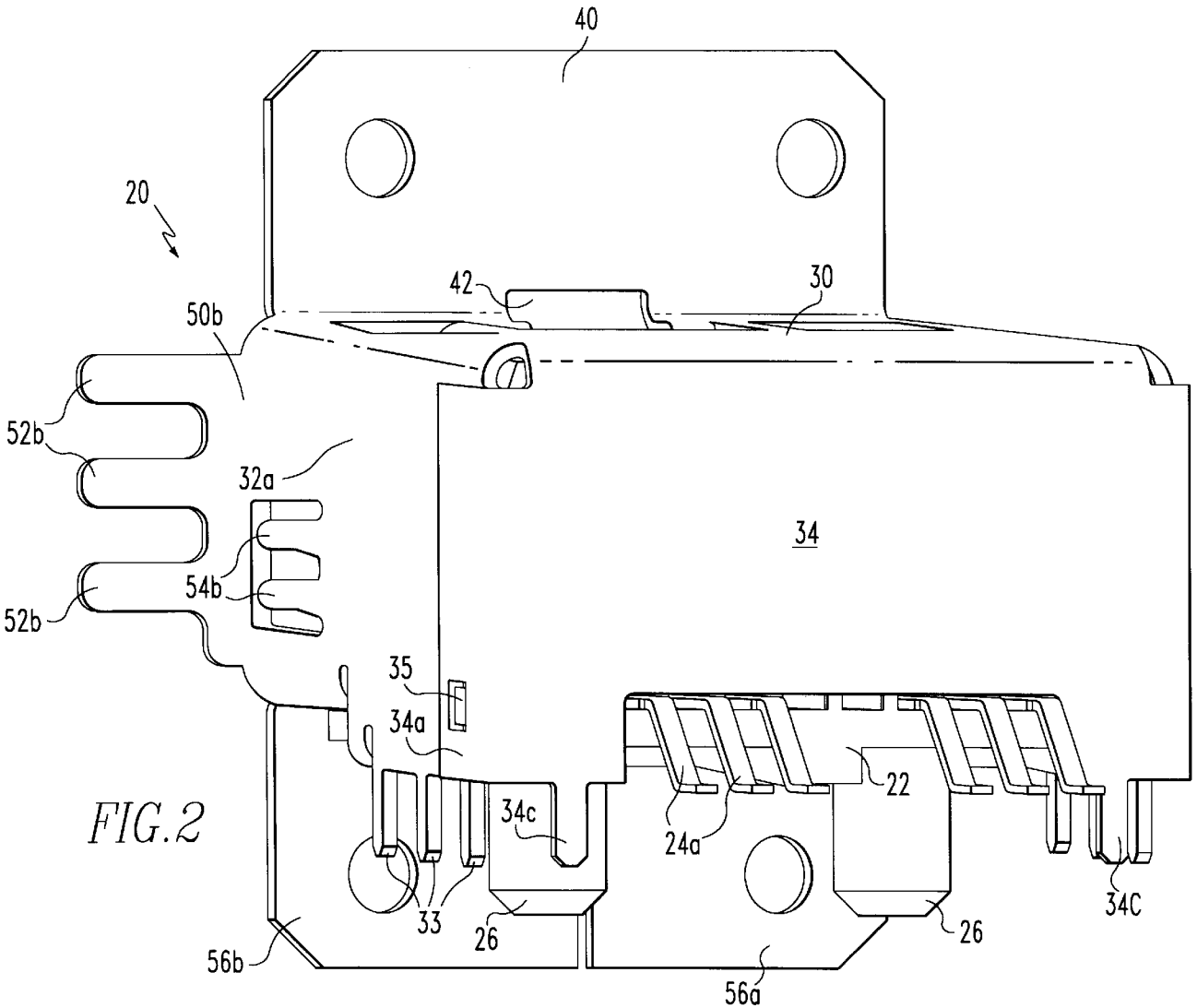
FIG. 2 is a rear isometric view of the connector shown in FIG. 1.

FIG. 1 illustrates a receptacle connector 20. This receptacle comprises a molded plastic contact retaining body 22 having an integral rear wall 23. A plurality of conductive contact terminals 24 are retained on the retainer body 22. The body 22 is molded of a polymeric insulator material. A pair of upper guide members 23*a* (FIGS. 1, 3 and 10) extend forwardly from the wall 23. The tails 24*a* of the terminals 24 extend rearwardly from the body 22 and, as shown, can comprise surface mount tails (FIG. 2). One or more pegs 26 may be integrally molded with insulator 22. The pegs 26 provide location and hold down functions when the connector is mounted on a printed circuit board.

Surrounding the insulator 22 is a shield 28 formed of suitable metallic sheet material. The shield 28 includes a top wall 30, opposed side walls 32*a* and 32*b* and a rear wall 34. Side walls 32*a* and 32*b* include through hole tails 33 adapted to be inserted and soldered or press fit into plated through holes of the circuit board on which the connector is mounted. Back wall 34 carriers similar through hole tails 34*c*. Alternatively the shield tails can be configured for surface mounting. Rear wall 34 also includes tabs 34*a* and 34*b* that are wrapped over the rear portions of the side walls 32*a* and 32*b*. A latch 35 formed on body 22 holds rear wall 34 in position.

The shield 28 also includes bottom wall portions 36*a*, 36*b*. The top wall 30, side walls 32*a*, 32*b* and bottom walls 36*a*, 36*b* define a generally rectangular opening or chamber 38 that is adapted to receive a mating plug connector (later described) adapted to be inserted into the receptacle 20 along the insertion axis A.

The shield also includes a plurality of flanges that extend generally transverse to the direction of the insertion axis A. These include the top flange 40, a bottom flange formed of flange portions 56*a*, 56*b* and a pair of opposed side flanges 50*a*, 50*b*.

Figure 7:
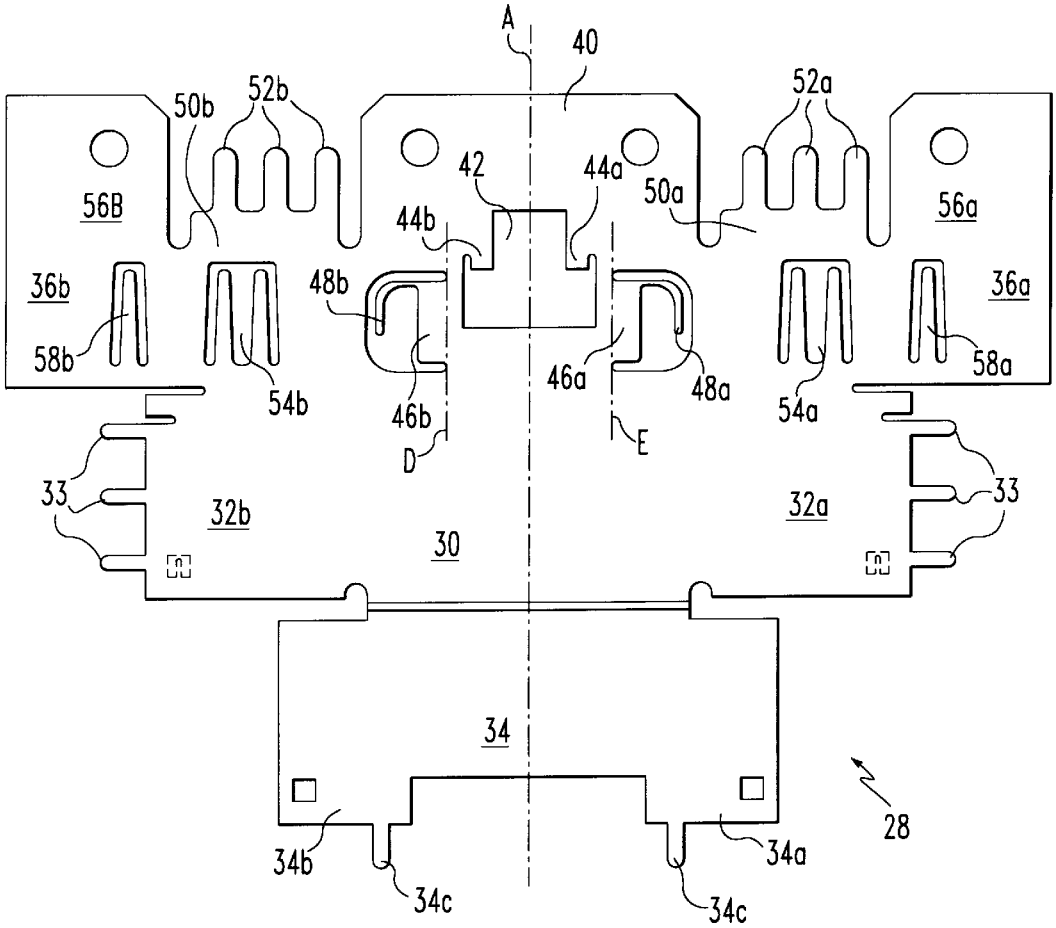
FIG. 7 is a depiction of a stamped shield blank before it is folded to shape.

As shown in FIGS. 1, 2 and 7, a latch receiving slot 42 is formed in the top wall 30 and flange 40. A pair of latching shoulders 44*a*, 44*b* are formed along opposed sides of the slot 42. The shoulders 44*a*, 44*b* are preferably formed by bending to form in-turned tangs that have flat latching surfaces or shoulders that are generally perpendicular to the insertion axis A. This structure is adapted to cooperate with a latch arm mounted on a mating connector, as will be subsequently described. It is also designed to emulate sensory perceptions of such plugs latching into molded plastic housings.

Figure 5:
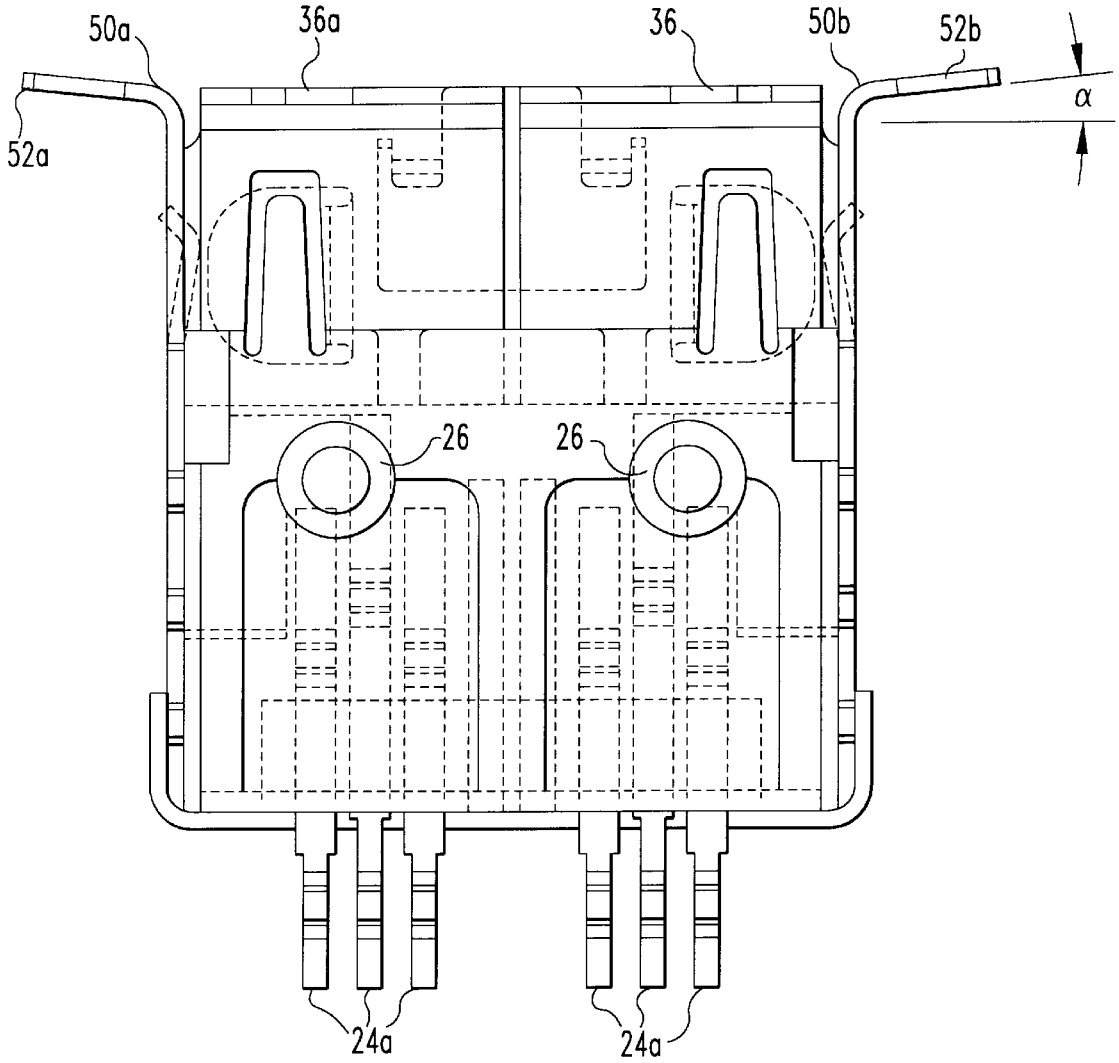
FIG. 5 is a bottom view of the connector shown in FIG. 1.
Figure 6:
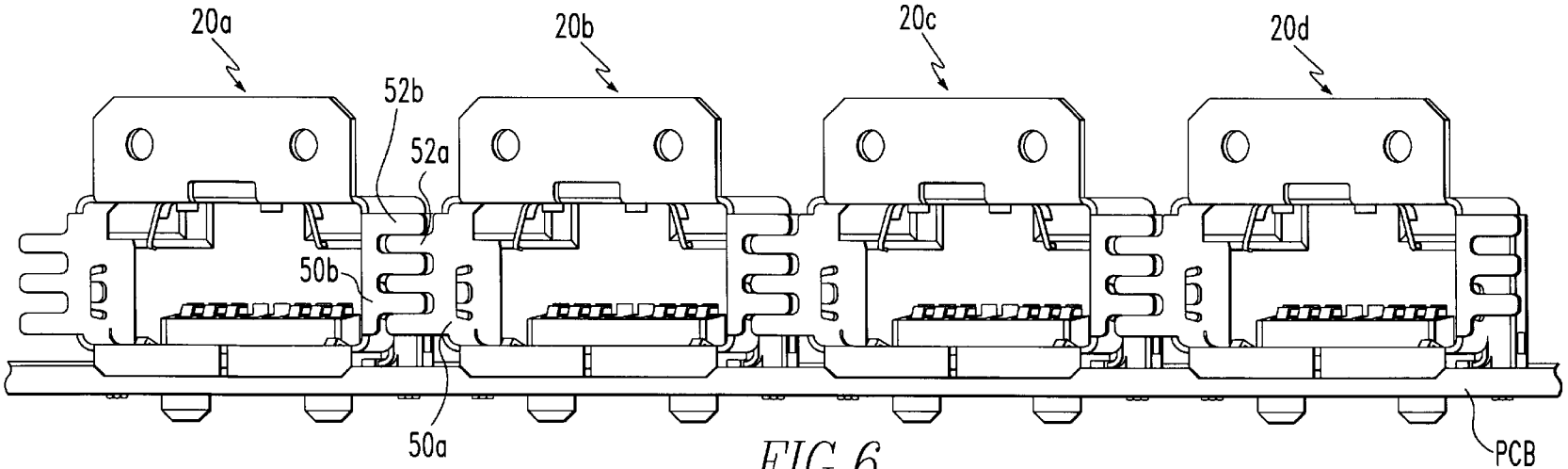
FIG. 6 is an isometric view of four connectors mounted in side by side relationship on a printed circuit board.

Each of the side flanges 50*a*, 50*b* is provided with interfitting sections along the distal edges of the flanges. In the embodiment shown in FIG. 1, these intermitting sections comprise a plurality of fingers 52*a* and 52*b*. The longitudinal axes of the fingers 52*a* are offset from the longitudinal axes of the fingers 52*b* so that, when similar receptacles 20*a*–20*d* (FIG. 6) are placed in side by side relationship, the fingers are interleaved. This improves shielding for the assembled row of connectors and allows closer side by side spacing of the connectors. As shown in FIG. 5, the side flanges 50*a*, 50*b*, are, prior to mounting, disposed at a slight angle $\alpha$ with respect to a transverse plane normal to the insertion axis A. These flanges are adapted to be flexed rearwardly to approximately a right angle position when the flanges are pushed against the back side of an equipment panel (not shown), against which the receptacles 20*a*–20*b* are mounted.

Figure 3:
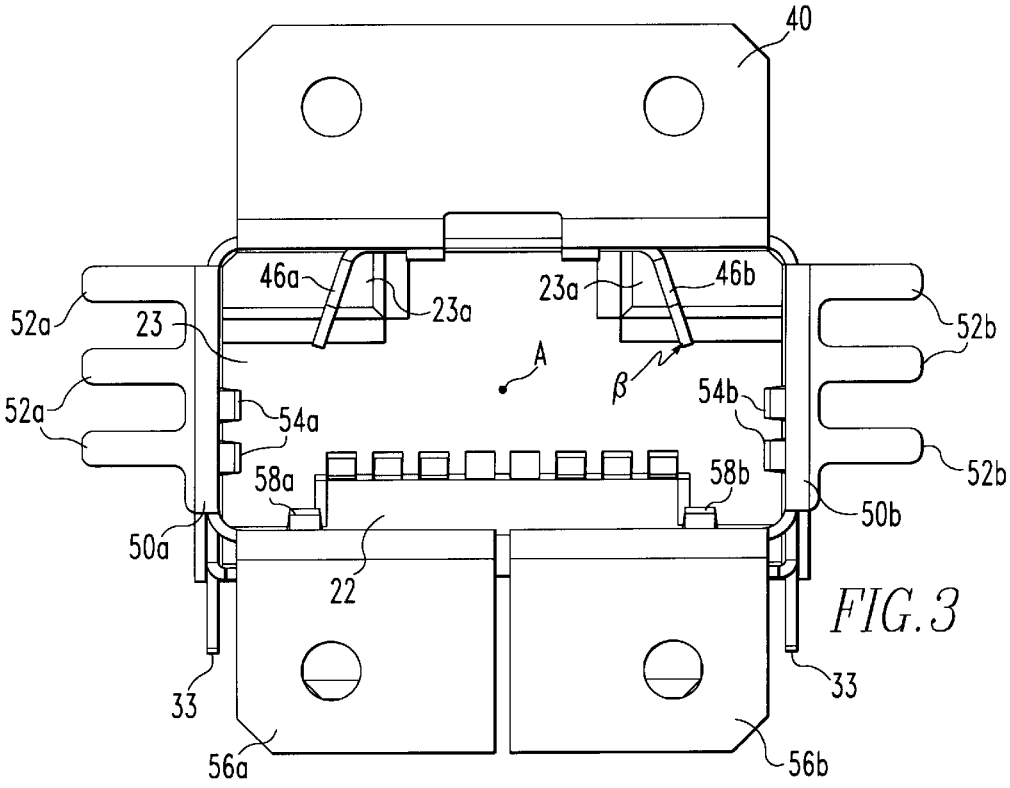
FIG. 3 is a front elevation of the connector shown in FIG. 1.
Figure 8:
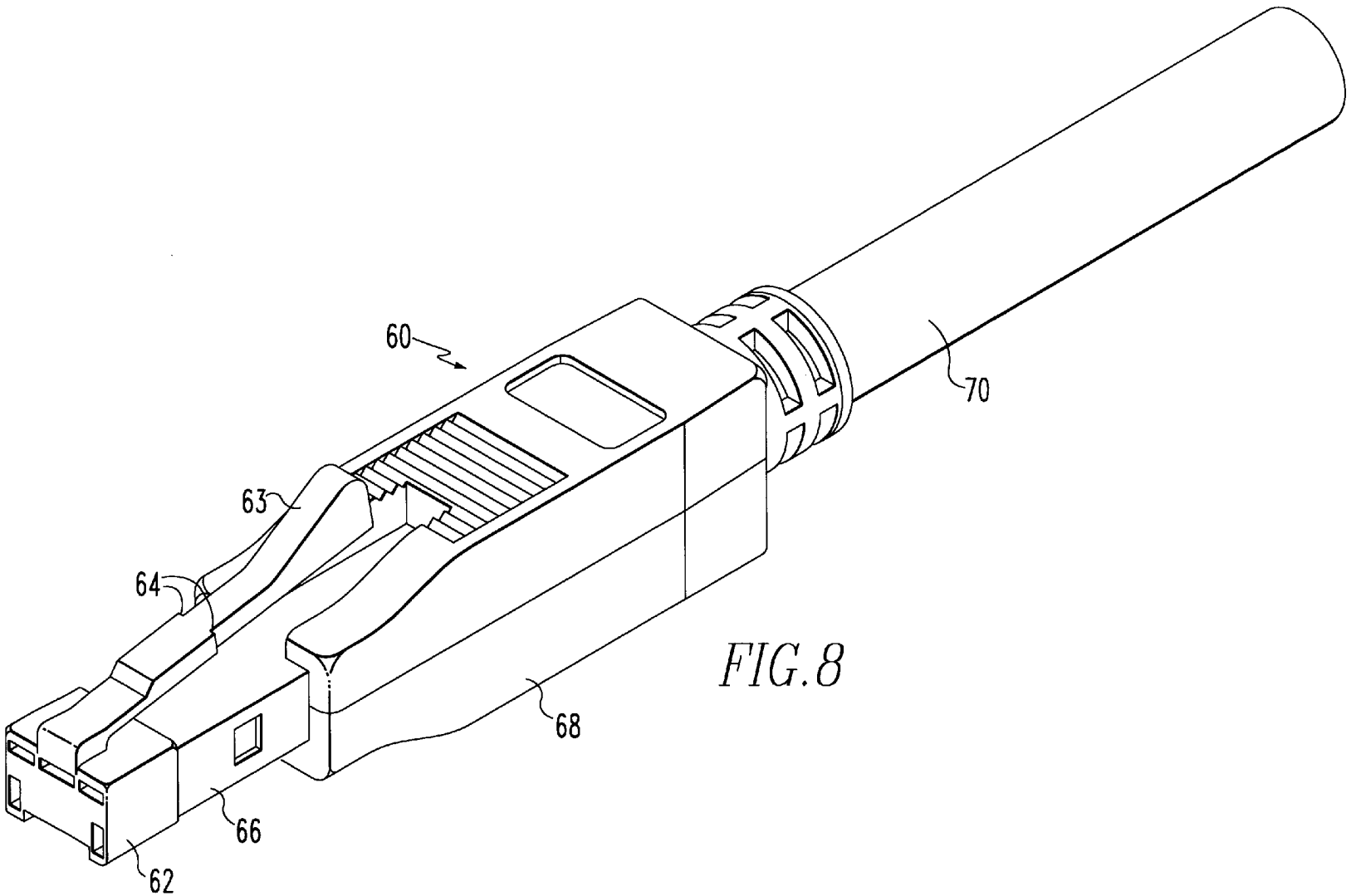
FIG. 8 is a isometric view of a plug connector for mating with the receptacle connector of FIG. 1.

The shield 28 includes a plurality of contacts for assuring electrical connection between the receptacle 20 and a mating plug 60 (FIG. 8). These structures include the top contact members 46*a* and 46*b*, the side contact fingers 54*a* and 54*b*, and the bottom contact members 58*a*, 58*b*. The top contact members 46*a*, 46*b* are formed from the top wall 30 and are canted inwardly into the opening 38 along flexural axes D and E (FIG. 8). As shown in FIG. 7, the flexural axes D and E are preferably parallel to the insertion axis A, but could be disposed in angular relation thereto, up to about a 90° angle. As shown in FIG. 3, the upper contact members 46*a*, 46*b* are disposed at an angle $\beta$ with respect to a plane normal to the top wall 30*a*. The contacts 46*a*, 46*b* include compliant contact members 48*a*, 48*b*, preferably in the form of cantilevered arms that can be flexed toward the flexural axes D and E respectively.

A plurality of forwardly extending contacts 54*a*, 54*b* are formed in the side walls 32*a*, 32*b* respectively. These contact fingers are positioned to engage side walls of the mating plug. Contact between the bottom walls 36*a*, 36*b* and the bottom surface of the plug is achieved through forwardly extending contact fingers 58*a*, 58*b*. Thus it can be seen that electrical contact is established between the top, bottom and side walls of the receptacle 20 and the plug 60.

Figure 4:
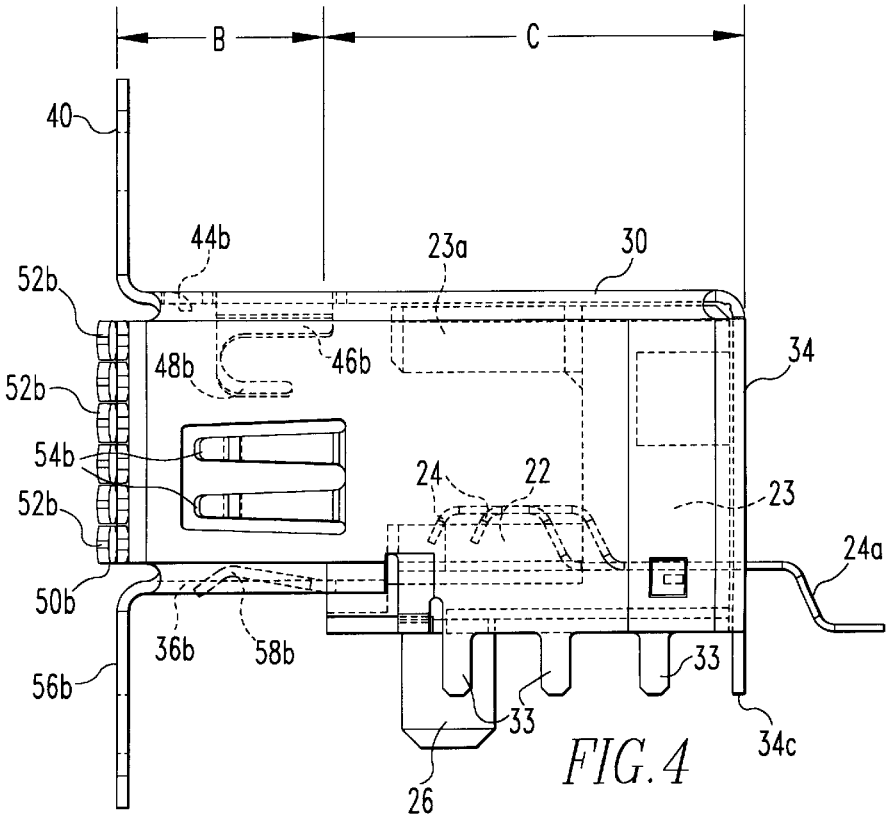
FIG. 4 is a side elevation of the connector of FIG. 1.

As shown in FIG. 4, the shield 28 includes a front zone B, wherein the mating plug is surrounded on all four sides by the metal shield, and a rear zone C, wherein the insulator 22 is surrounded at the top and on the sides by the shield 28. The arrangement of the shield sections and surrounding relationship of the contacts 46*a*, 46*b*, 54*a*, 54*b*, and 58*a*, 58*b* ensures a low impedance connection between the shield 28 (and ultimately the printed circuit board) and the plug 60.

FIG. 7 illustrates the flat blank from which the shield 28 is formed. As can be seen from FIGS. 1 and 2, the back wall 34 is formed by bending downwardly along the junction between wall 34 and top section 30. The tabs 34*a*, 34*b* are formed by bending the tabs forwardly at approximately a 90° angle to the back wall 34. Side walls 32*a*, 32*b* are formed by bending along the top wall edges generally parallel with insertion axis A. Similarly, bottom walls 36*a*, 36*b* are formed by bending the shield along the junctions between the sections 36*a*, 36*b* and the side walls 32*a*, 32*b*. The flanges 40, 50*a*, 50*b*, and 56*a*, 56*b*, are similarly formed by bending from the blank shown in FIG. 1. As well, the contact elements 46*a*, 46*b*, 54*a*, 54*b* and 58*a*, 58*b* are formed by stamping and bending from the blank shown in FIGS. 1 and 2.

Referring to FIG. 8, a typical mating plug connector 60 is illustrated. This plug includes an insulative nose section 62 that serves as an insulator for contacts (not shown) that are carried on the bottom side of the nose and engage the receptacle contacts 24. The nose is preferably formed of an insulative polymeric material. A latch arm 63, having latching surfaces 64, is preferably integrally molded with the nose 62. The plug includes a metallic shield section 66 that surrounds the conductors within the plug from the nose 62 rearwardly toward the cable 70. The plug includes an overmold section 68 utilized primarily for gripping the plug.

Figure 9:
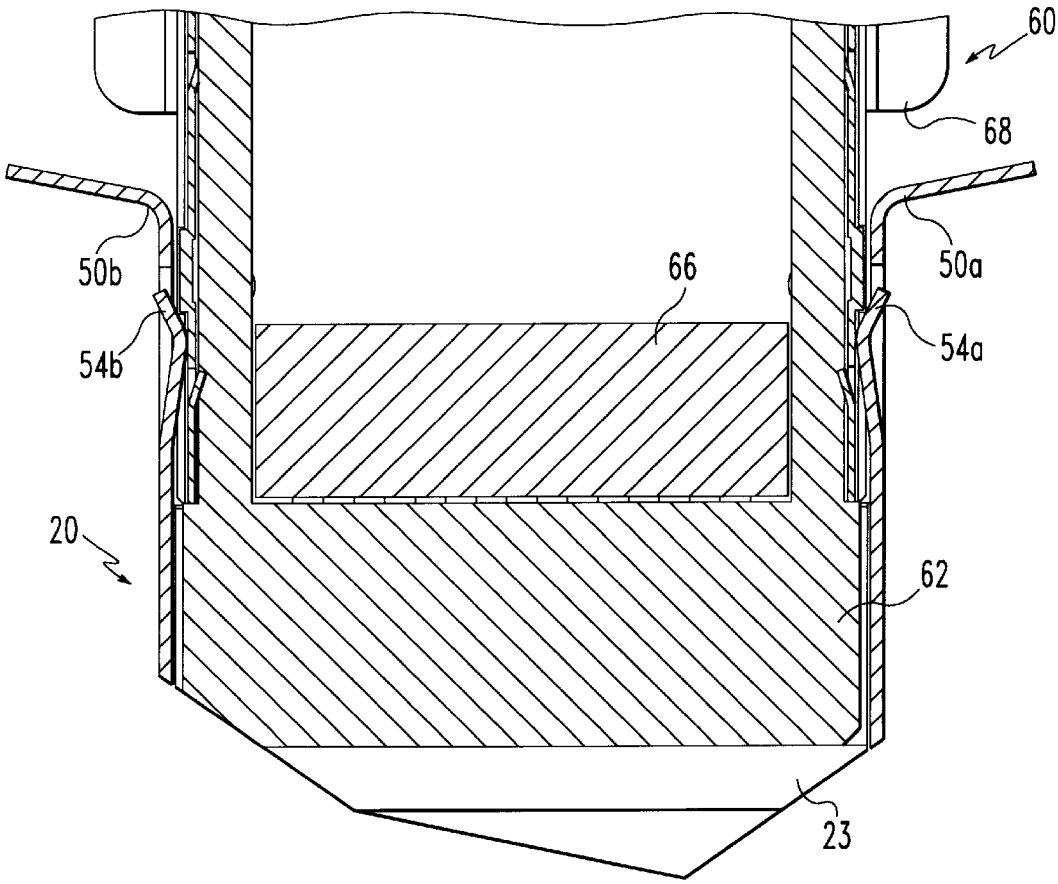
FIG. 9 is a fragmentary cross-sectional top view showing the plug connector of FIG. 8 inserted into the receptacle connector of FIG. 1.

As shown in FIG. 9, when the plug 60 is inserted into the receptacle 20 in its fully mated position, the side contacts 54*a*, 54*b* engage the side walls of the shield 66 to establish an electrical connection therewith. In this position, the front wall of the nose section 62 is positioned against the wall 23 of insulator 22. The nose section is held in vertical location by the body 22 and the guide sections 23*a*.

Figure 11:
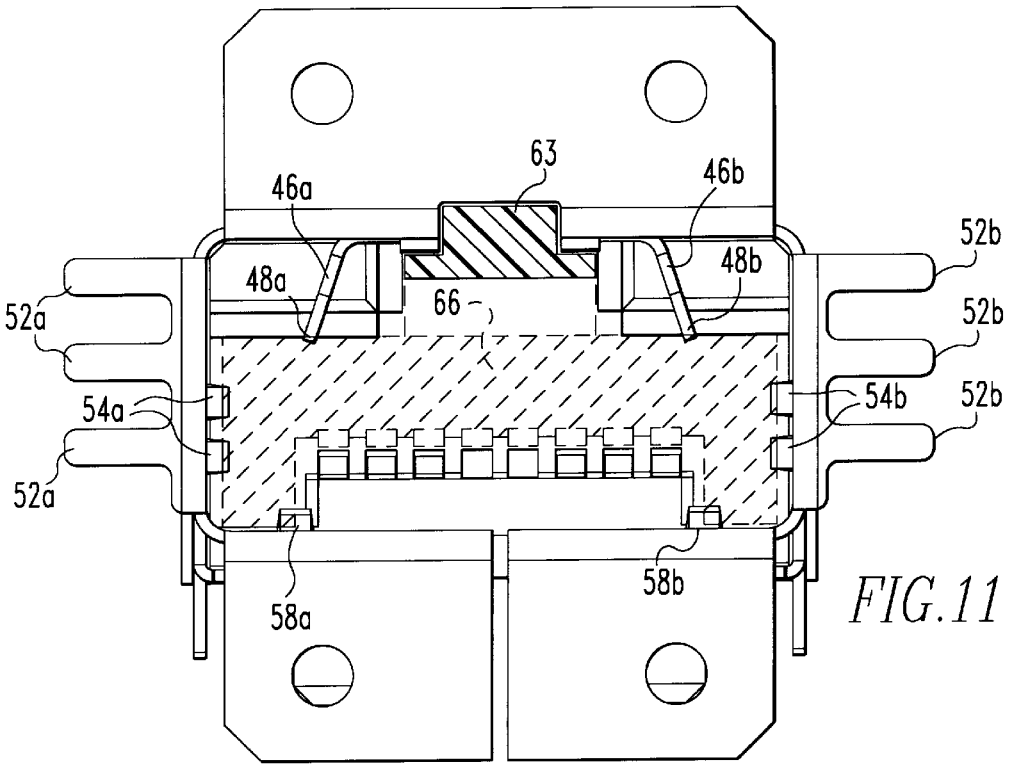
FIG. 11 is a front elevational view of the connector shown in FIG. 1 with the plug of FIG. 8 shown (in cross-section) in mated condition.
Figure 10:
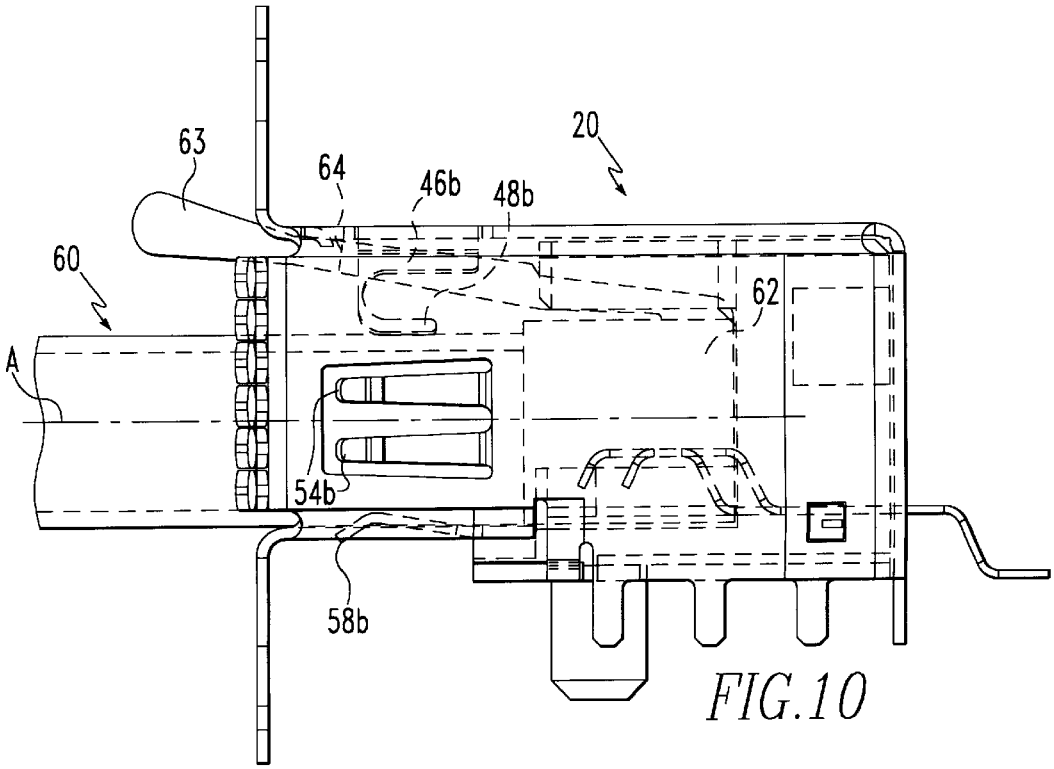
FIG. 10 is a side view of the receptacle connector of FIG. 1 with the plug connector of FIG. 8 mated in the receptacle.
Figure 12:
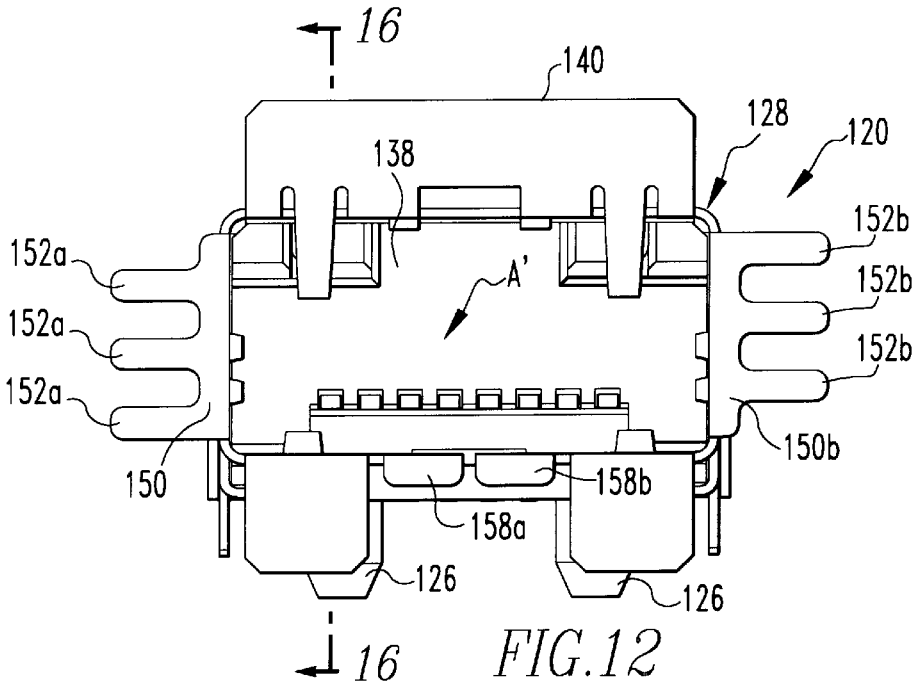
FIG. 12 is a front elevational view of a connector representing a second preferred embodiment of the present invention.
Figure 15:
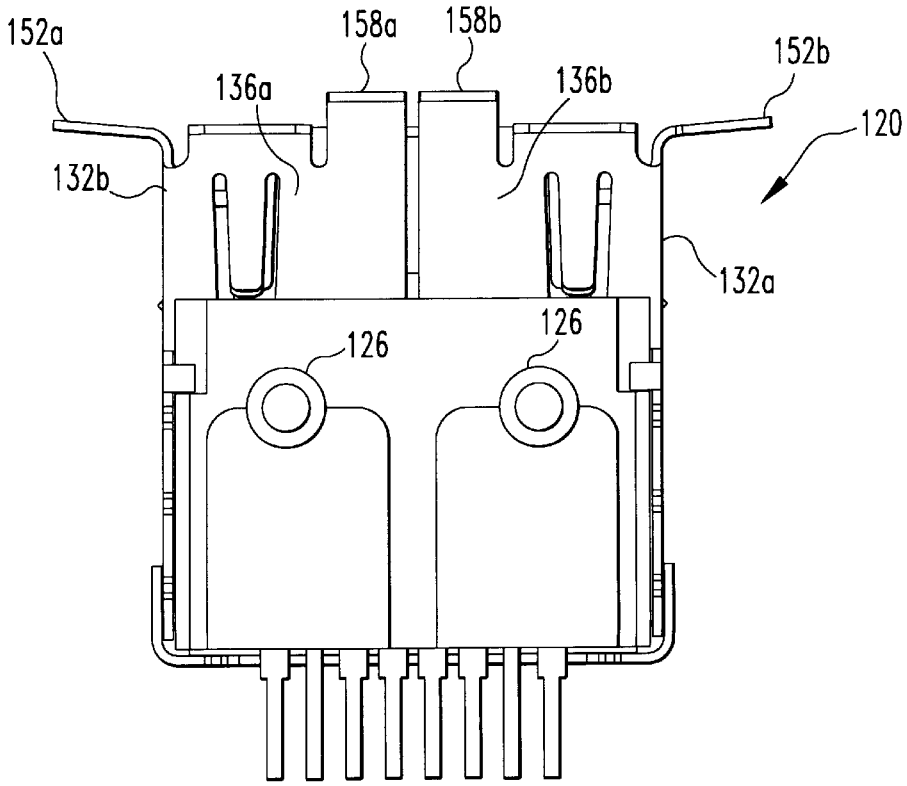
FIG. 15 is a bottom plan view of the connector shown in FIG. 12.
Figure 14:
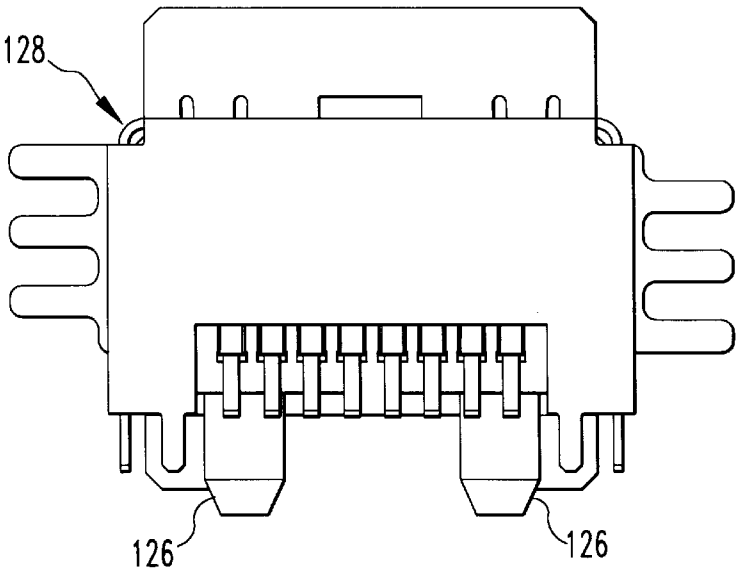
FIG. 14 is a rear elevational view of the connector shown in FIG. 12.
Figure 13:
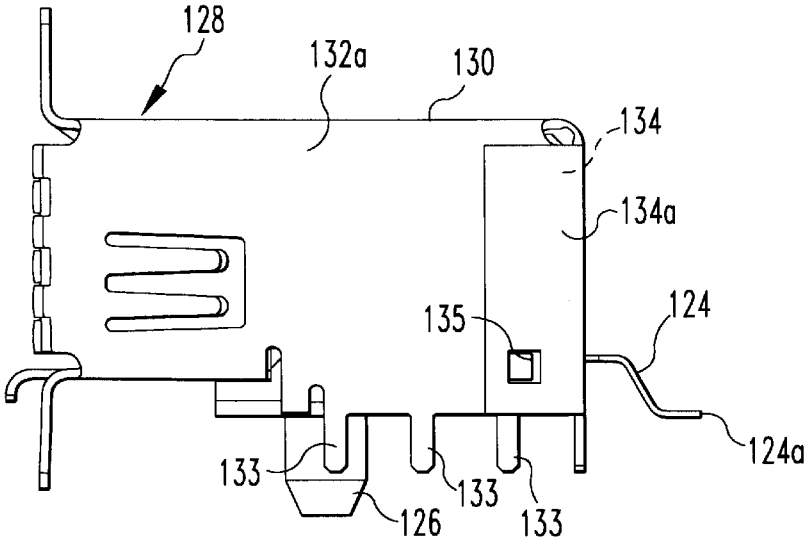
FIG. 13 is a side elevational view of the connector shown in FIG. 12.
Figure 16:
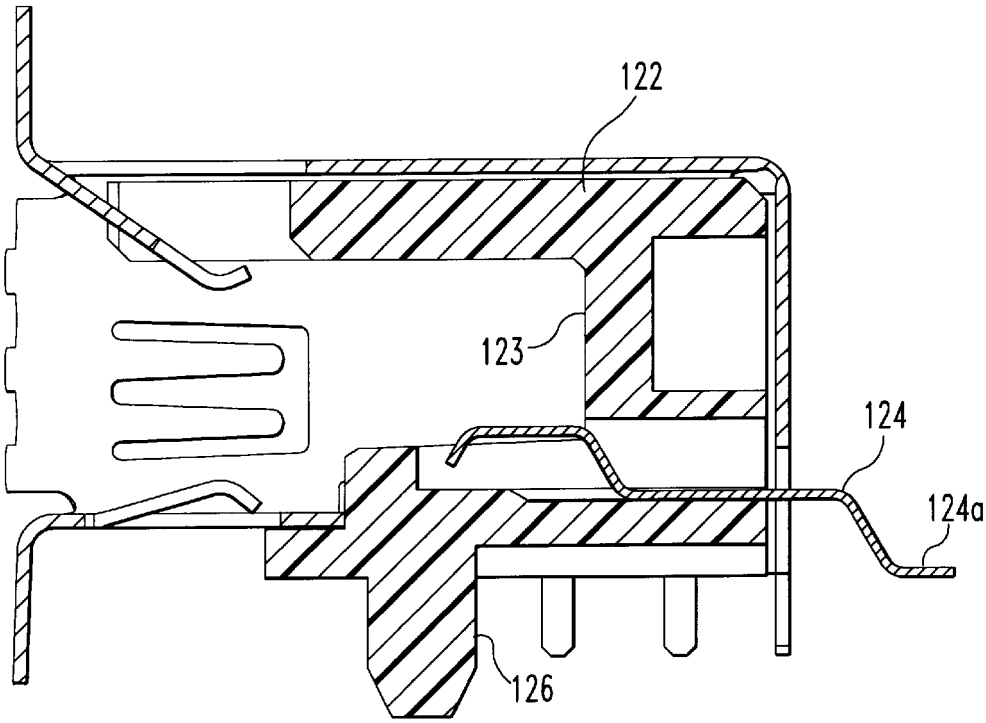
FIG. 16 is a cross sectional view through 16—16 in FIG. 12.
Figure 18:
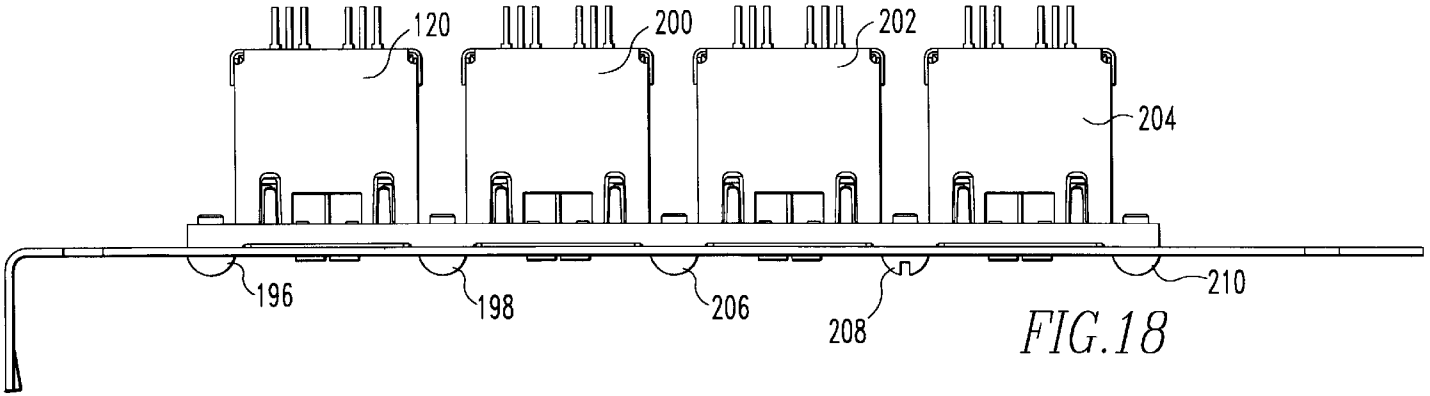
FIG. 18 is a top plan view of the assembly shown in FIG. 17.
Figure 17:
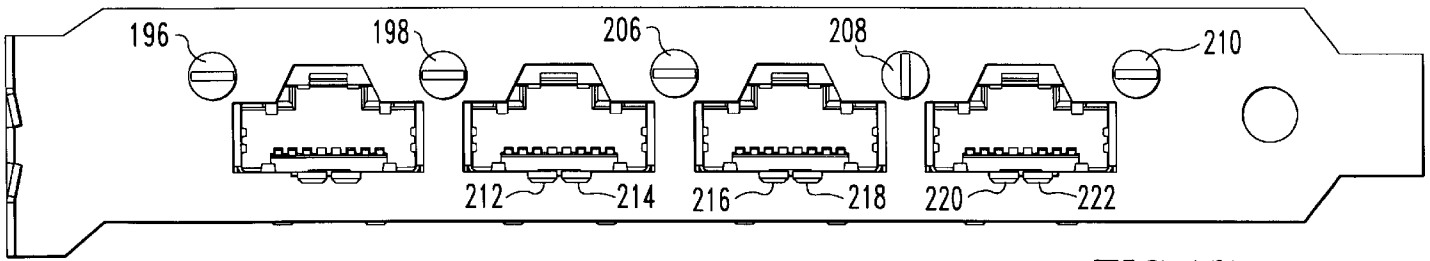
FIG. 17 is a front elevational view of an assembly comprising a plurality of connectors like the one shown in FIG. 12 which are mounted on a peripheral computer interface (PCI) bracket.
Figure 19:
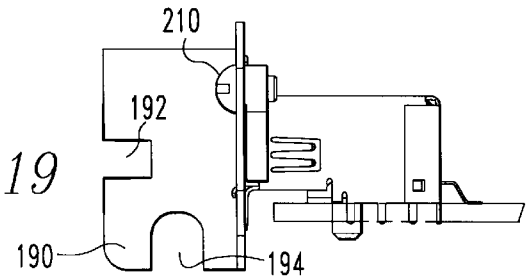
FIG. 19 is an end view of the assembly shown in FIG. 17.
Figure 20A:
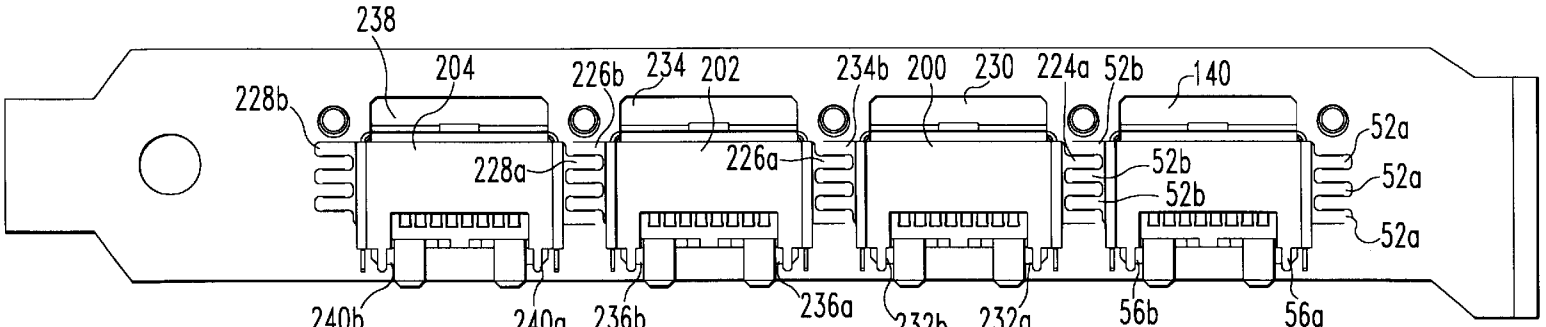
FIG. 20*a* is a rear elevational view of the assembly shown in FIG. 12 in which the rear attachment bracket has not yet been fixed to the assembly.
Figure 20B:
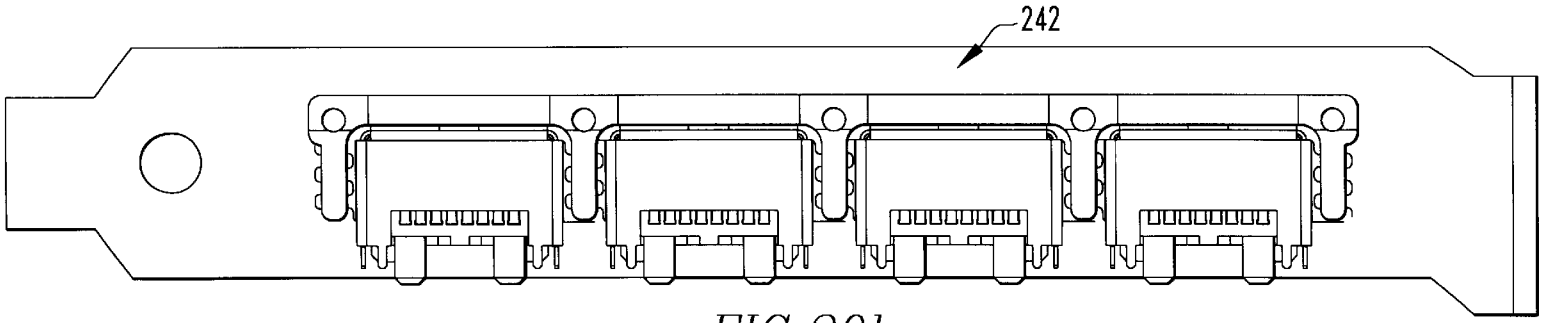
FIG. 20*b* is a rear elevational view of the assembly shown in FIG. 17 in which the rear attachment bracket has been fixed to the assembly.
Figure 21:
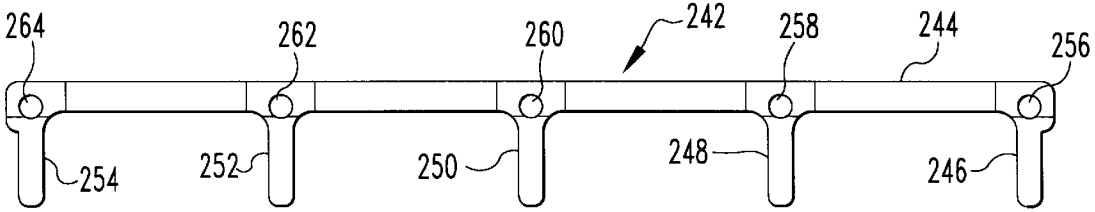
FIG. 21 is a front elevational view of the rear attachment bracket shown in FIG. 20*b;*
Figure 24:
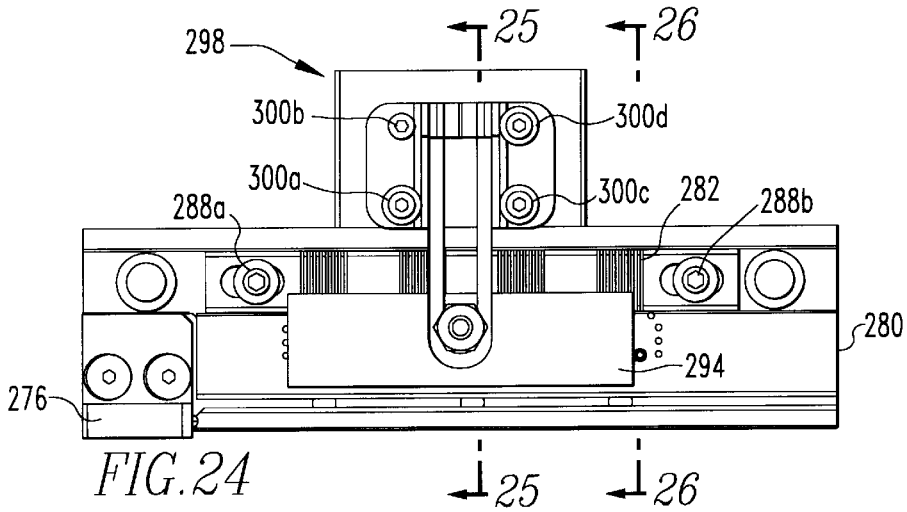
FIG. 24 is a top plan view of the assembly shown in FIG. 22.
Figure 22:
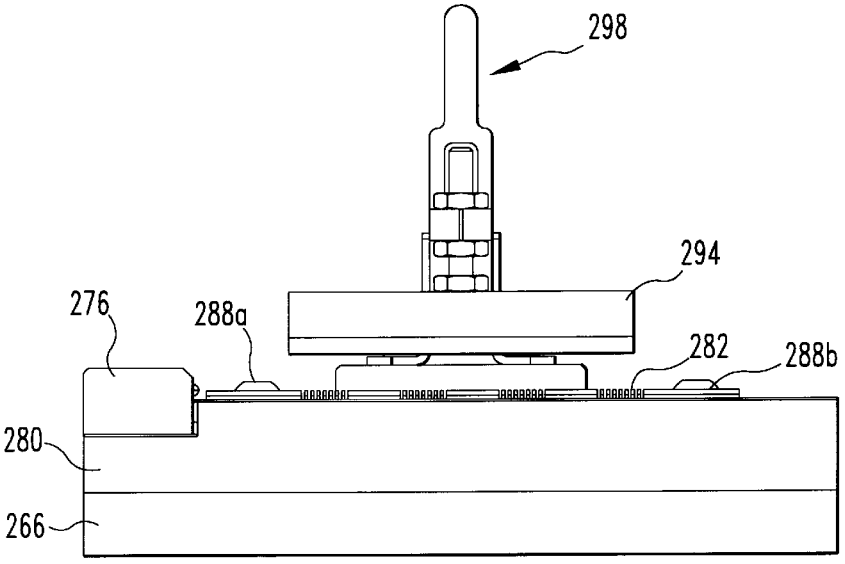
FIG. 22 is a front elevational view of a tool used to attach the connector shown in FIG. 12 to a PCI bracket in the manufacture of the assembly shown in FIG. 17.
Figure 23:
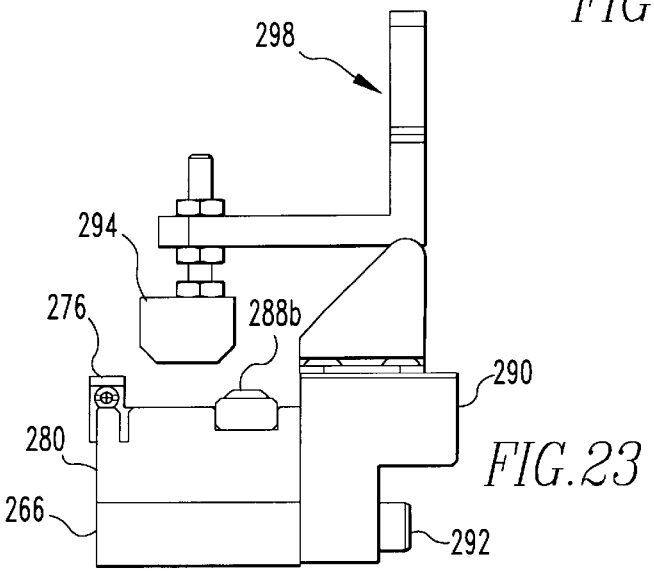
FIG. 23 is a side elevational view of the tool shown in FIG. 22.
Figure 25:
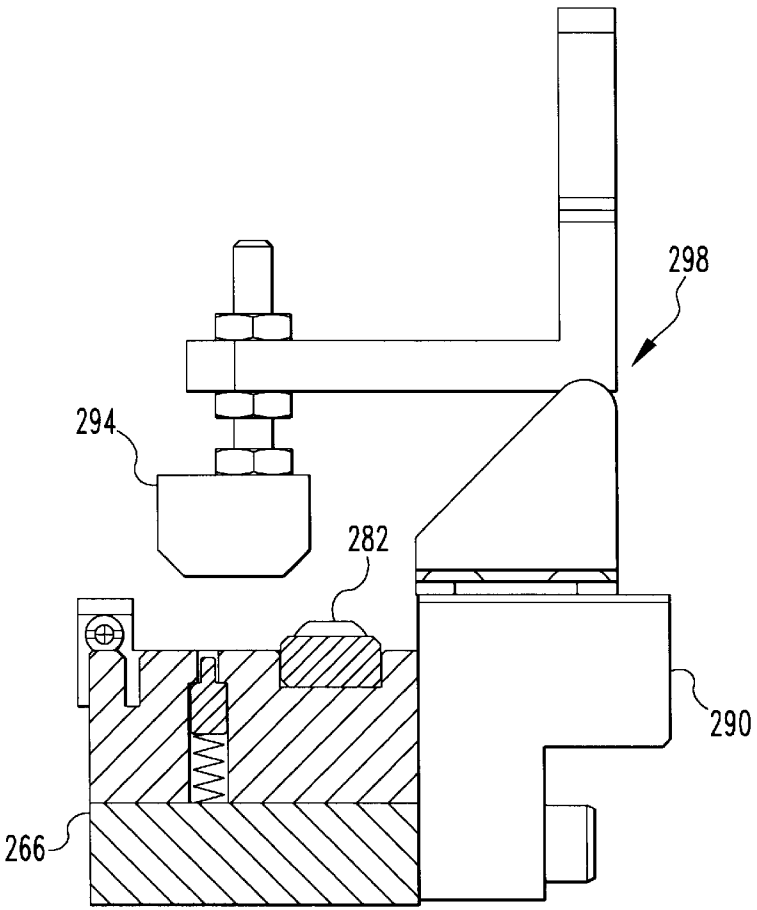
FIG. 25 is a cross sectional view through 25—25 and 24.
Figure 26:
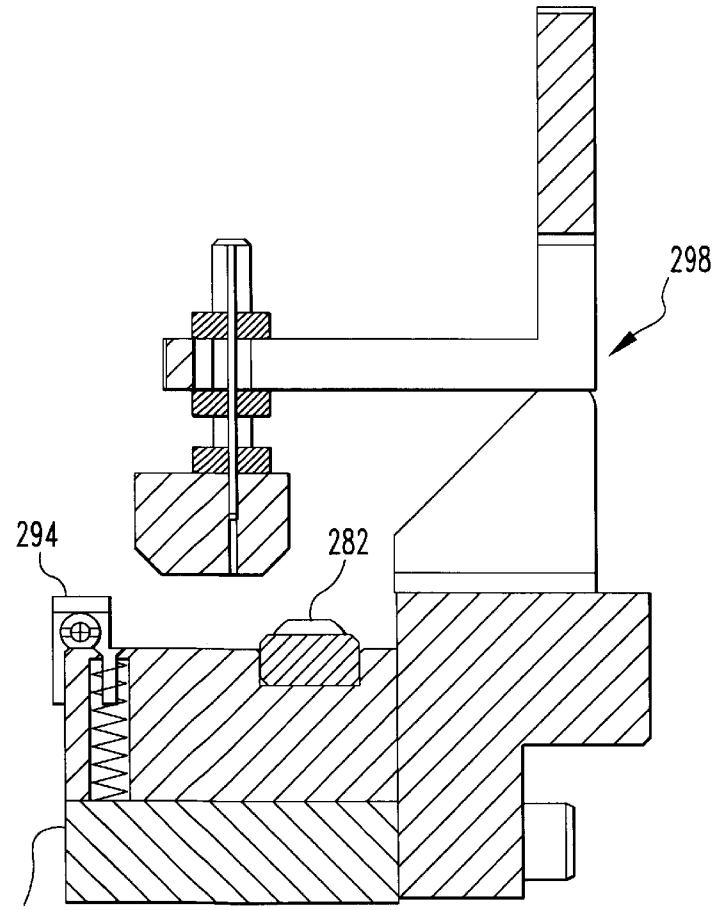
FIG. 26 is a cross sectional view through 26—26 in FIG. 26.
Figure 27:
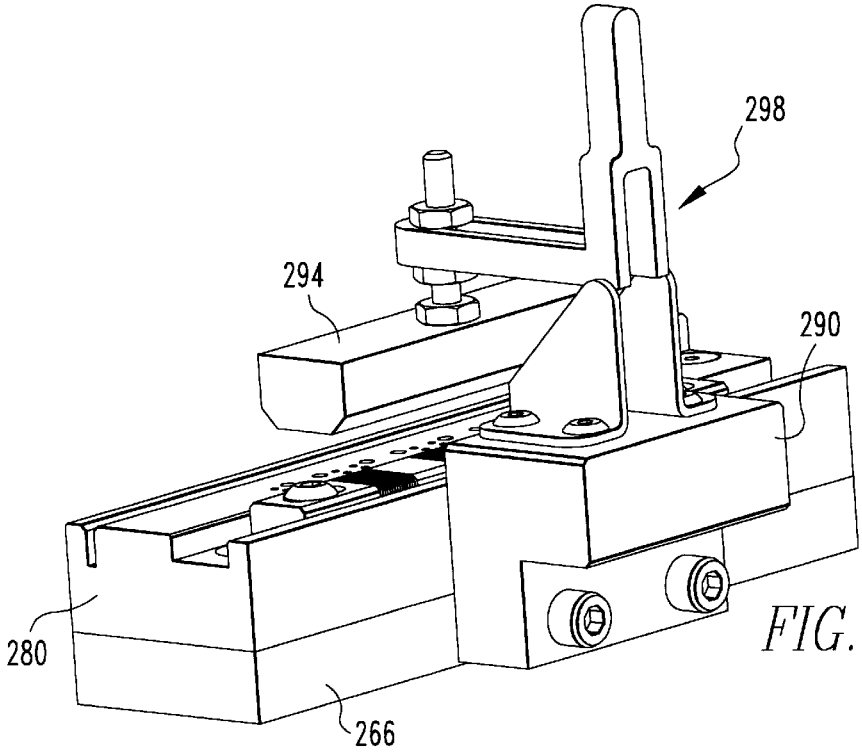
FIG. 27 is a rear perspective view of the tool shown in FIG. 22.
Figure 28:
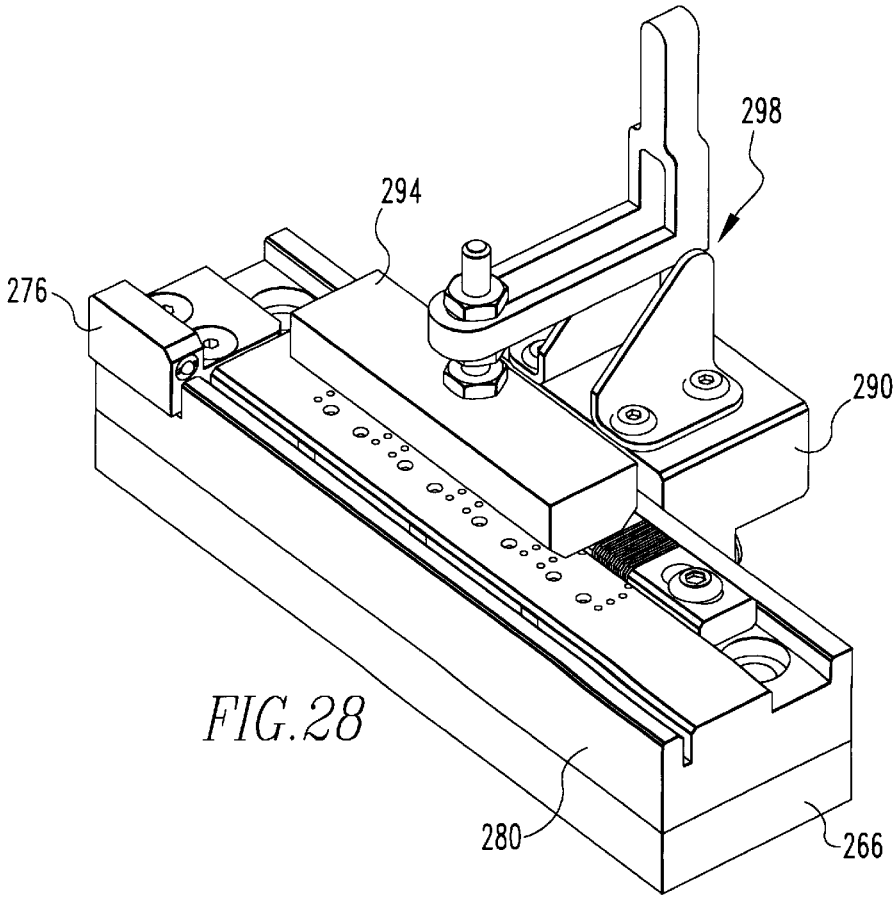
FIG. 28 is a front perspective view of the tool shown in FIG. 28.
Figure 29:
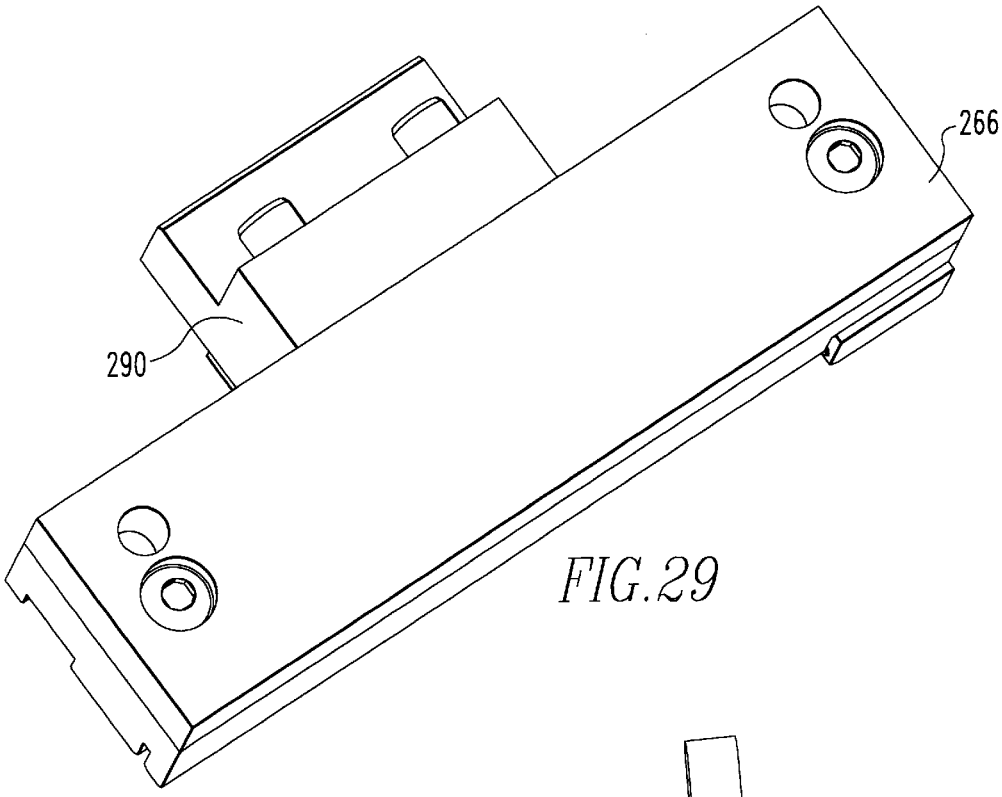
FIG. 29 is a bottom perspective view of the tool shown in FIG. 22.
Figure 30:
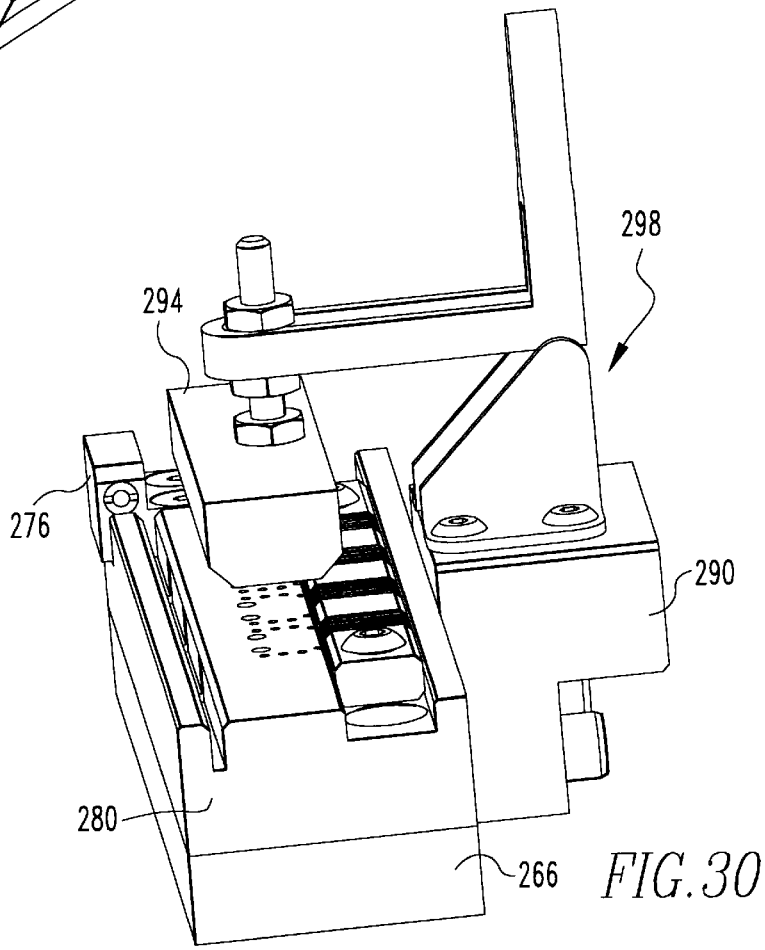
FIG. 30 is a side perspective view of the tool shown in FIG. 22.
Figure 31:
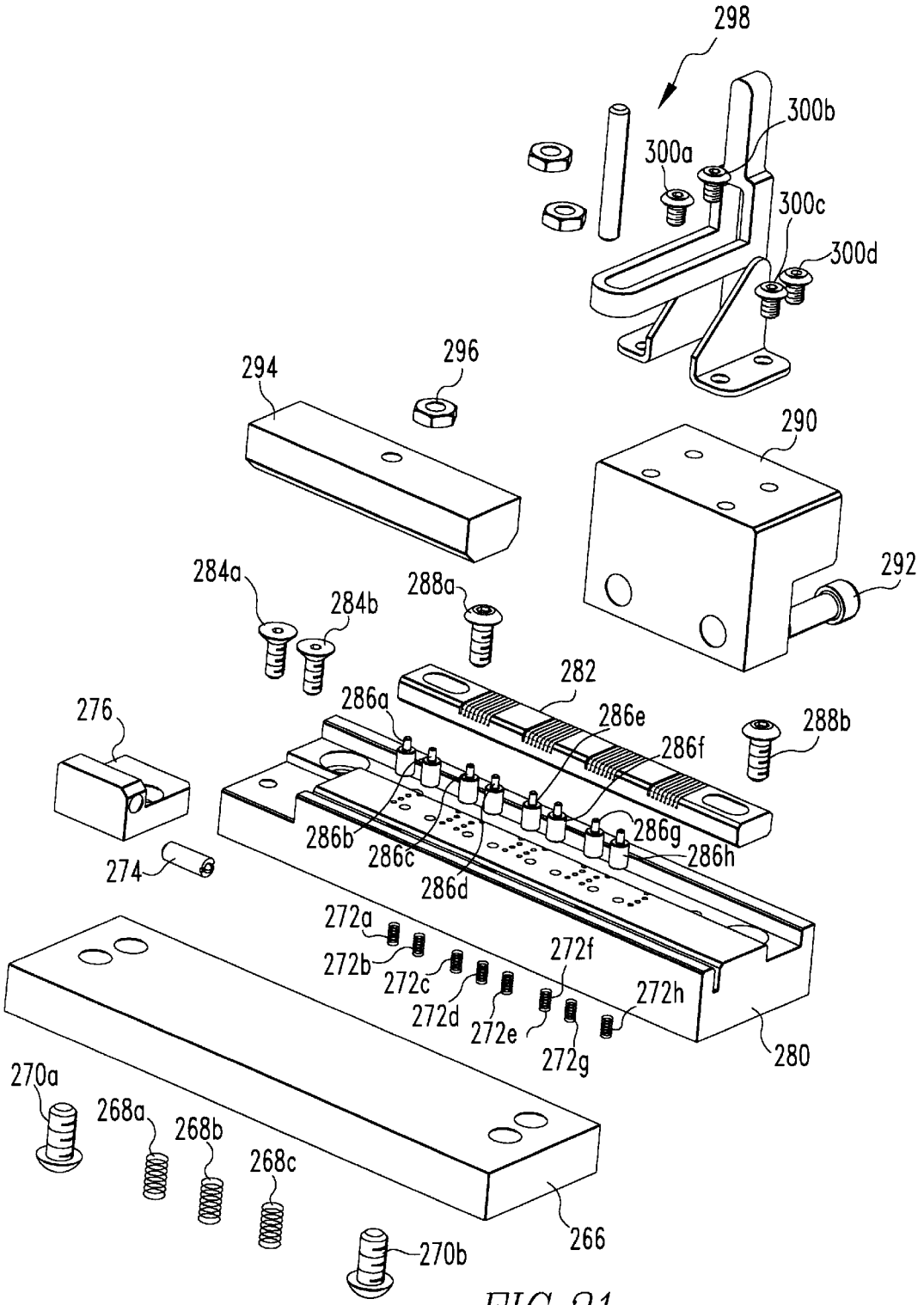
FIG. 31 is a front exploded view of the tool shown in FIG. 22.

As shown in FIG. 10, when the plug 60 is in fully mated position within the receptacle 20, the top contact 46*a*, 46*b* engage the top wall of shield 66 via the cantilever arms 48*a* and 48*b*. Similarly, the forwardly extending bottom contact members 58*a*, 58*b* engage the bottom surface of the shield 66. As shown in FIG. 11, in the mated position, the top contact members 46*a* and 46*b* touch the top surface of the shield 66 of the plug. The upper contacts 46*a*, 46*b* are capable of being deflected by rotation about the flexural axes D and E respectively and by compliance of the cantilevered arms 48*a*, 48*b*. This structure allows the generation of substantial normal forces by the upper contacts 46*a* and 46*b* within the relatively limited axial length of the zone B of shield 28.

As can be realized particularly from FIGS. 4 and 8, the plug 60 and receptacle 20 are held in mated condition by the engagement of the latch surfaces 64 with the bent latch tangs 44*a*, 44*b*. Release of the plug is permitted by pressing the latch arm 63 downwardly toward the shield 66 to release the surfaces 64 from the tangs 44*a*, 44*b*.

The described features above result in an interconnection system that has improved shielding and overall lower impedance. As a result, higher signal frequencies can be passed through this interconnection system within acceptable levels of signal degradation. The improved performance is believed to result, at least in part, by minimization of the length of ground paths from the plug to the printed circuit board as a result of the location and/or orientation of the various grounding contacts formed in the shield.

The latching structure described provides essentially the same tactile feel and aural sensation as achieved with latch structures formed in molded plastic housings. Thus the user has the same sensory perceptions that occur when the plug latch assumes the latched position or is unlatched with the disclosed structure as with previous molded receptacle housings.

Referring to FIGS. 22–31, an apparatus for mounting a plurality of the receptacles to a PCI bracket is shown for forming the assembly shown in FIGS. 17–20. This apparatus includes a base plate 266 which includes PCI eject springs 268*a*, 268*b* and 268*c*. The base plate 266 is also connector to the rest of the assembly by means of fasteners 270*a* and 270*b*. Superimposed over the base plate there are connector peg springs 272*a*–272*h*. There is a ball plunger 274 mounted in a ball plunger housing 276 which along with ejector pegs 278 is mounted on an alignment plate 280. Superimposed on the base plate there is a connector spacer 282 and fasteners 284 and 284*b*, ejector pegs 286*a*–286*b* and fasteners 288 and 288*b*. Also superimposed on the alignment plate is a clamp bracket 290 which is attached to the apparatus assembly by means of bolts as at 292. The apparatus assembly also includes a hold-down block 294 and a fastening nut 296 as well as a clamp assembly shown generally at 298 which is held to the clamp bracket 290 by means of fasteners 300*a*, 300*b*, 300*c* and 300*d*.

Up to four receptacle as is shown in FIGS. 12–16 may be mounted on a PCI bracket. The alignment support plate which has a series of slots is used to accurately position or reposition any of the contact tails as the connectors are being loaded into the fixture. A vertical clamp is used to hold the connectors in place. A spring loaded plunger and a series of internal springs in the base are used to accurately position the PCI bracket with respect to the connectors. Once located, the PCI bracket is permanently attached to the connectors using a support bracket and machine screws. The clamp is then removed which allows the eject pins to lift out the fixture with the completed PCI bracket.

While the present invention has been described in connection with the preferred embodiments of the various Figs., it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for mounting electrical connectors on a PCI bracket comprising:

(a) an alignment member containing a plurality of connector portion receiving apertures for receiving portions of the connectors in the apertures and at least one spring loaded eject pin in the apertures;

(b) a connector spacer connected to the alignment member and having a plurality of contact tail slots used to position contact tails of the connectors on the connector spacer;

(c) a clamp connected to the alignment member and used to hold the connectors in place against the alignment member; and (d) a spring loaded plunger connected to the alignment member and adapted to contact the PCI bracket to accurately position the PCI bracket with respect to the alignment member and the connectors on the alignment member.

2. The apparatus of claim 1 further comprising a base and wherein the alignment member is stationarily attached to the base by fasteners.

3. The apparatus of claim 2 wherein the clamp is connected by the base to the alignment member.

4. The apparatus of claim 2 wherein the eject pin is spring loaded by a spring located against the base.

5. The apparatus of claim 1 wherein the alignment member comprises a groove for receiving the PCI bracket, and wherein the apparatus further comprises eject springs located in the alignment member and projecting into the groove.

* * * * *